US006701559B2

(12) United States Patent
Boso et al.

(10) Patent No.: US 6,701,559 B2
(45) Date of Patent: Mar. 9, 2004

(54) INCREASED HEIGHT INFLATABLE SUPPORT SYSTEM

(75) Inventors: Karen L. Boso, Woodstock, IL (US); Chen Ching-Chin, Taipei (TW)

(73) Assignee: Aero Products International, Inc., Wauconda, IL (US)

( * ) Notice: Subject to any disclaimer, the term of this patent is extended or adjusted under 35 U.S.C. 154(b) by 0 days.

(21) Appl. No.: 09/918,561

(22) Filed: Aug. 1, 2001

(65) Prior Publication Data

US 2003/0024050 A1 Feb. 6, 2003

(51) Int. Cl.[7] ..... A47C 27/10

(52) U.S. Cl. ..... 5/739; 5/711; 5/713; 5/424

(58) Field of Search ..... 5/706, 710, 711, 5/712, 713, 739, 424, 732

(56) References Cited

U.S. PATENT DOCUMENTS

| | | | | |
|---|---|---|---|---|
| 388,037 A | | 8/1888 | Hargin | |
| 625,114 A | | 5/1899 | MacSpadden | |
| 679,519 A | | 7/1901 | Smith | |
| 918,391 A | | 4/1909 | Taarud | |
| 1,185,684 A | | 6/1916 | Kraft et al. | |
| 1,263,599 A | | 4/1918 | Poole | |
| 1,451,136 A | | 8/1923 | Allnutt | |
| 1,576,211 A | * | 3/1926 | O'Kane | 5/710 |
| 1,944,466 A | | 1/1934 | Rubin | 5/348 |
| 2,059,226 A | | 11/1936 | Gates | 5/347 |
| 2,064,695 A | | 12/1936 | Sipe | 152/12 |
| 2,112,641 A | | 3/1938 | Wheaton | 277/61 |
| 2,288,889 A | | 7/1942 | Costello | 273/65 |
| 2,369,736 A | | 2/1945 | Hurt | 5/348 |
| 2,372,218 A | | 3/1945 | Manson et al. | 5/348 |
| 2,415,150 A | | 2/1947 | Stein | 5/348 |
| 2,549,597 A | | 4/1951 | Harris et al. | 5/348 |
| 2,573,375 A | | 10/1951 | Winstead | 230/32 |
| 2,604,641 A | | 7/1952 | Reed | 5/349 |
| 2,614,272 A | * | 10/1952 | Morner | 5/655.3 |
| 2,701,579 A | | 2/1955 | Hasselquist | 137/223 |
| 2,741,780 A | | 4/1956 | Kimbrig | 5/348 |
| 2,767,735 A | | 10/1956 | Darling | 137/527 |
| 2,842,783 A | | 7/1958 | Druck | 5/348 |
| 2,949,927 A | | 8/1960 | Mackal | 137/223 |
| 3,026,909 A | | 3/1962 | Boteler | 137/793 |
| 3,042,941 A | | 7/1962 | Marcus | 5/348 |
| 3,068,494 A | | 12/1962 | Pinkwater | 5/348 |
| 3,099,386 A | | 7/1963 | Pieper | 230/117 |
| 3,123,336 A | | 3/1964 | Price | 251/331 |
| 3,128,480 A | | 4/1964 | Lineback | 5/348 |
| 3,142,850 A | | 8/1964 | De Boer | 9/11 |
| 3,155,991 A | | 11/1964 | Dunham | 5/348 |
| 3,208,721 A | | 9/1965 | McHugh | 251/331 |
| 3,403,696 A | | 10/1968 | Pynchon | 137/516.13 |
| 3,505,695 A | | 4/1970 | Bishaf et al. | 5/348 |
| 3,511,472 A | | 5/1970 | Zimmerman | 251/285 |
| 3,536,071 A | | 10/1970 | Ferrando | 128/142.5 |

(List continued on next page.)

FOREIGN PATENT DOCUMENTS

| | | |
|---|---|---|
| EP | 0 317 021 A1 | 5/1989 |
| GB | 841736 | 7/1960 |
| GB | 2 050 844 A | 1/1981 |
| IT | 359340 | 2/1938 |
| WO | WO 93/05684 | 4/1993 |

*Primary Examiner*—Michael F. Trettel
(74) *Attorney, Agent, or Firm*—Brinks Hofer Gilson & Lione

(57) ABSTRACT

An increased height inflatable support system consisting of two or more vertically stacked chambers. Such a support system can have one or more stabilizer bars attached to said support system, to help keep said support system from rolling over. In addition, the present invention introduces the concept of using a support chamber to provide additional strength at junctions between said vertically stacked chambers. Additionally, fabric, padding, or flocking may be added to one or more surfaces of an upper chamber to improve overall support system comfort.

16 Claims, 9 Drawing Sheets

U.S. PATENT DOCUMENTS 3,563,676 A 2/1971 Coovert et al. ..... 417/410
3,600,727 A 8/1971 Williams ..... 5/348
3,772,717 A * 11/1973 Yuen et al. ..... 5/422
3,785,395 A 1/1974 Andreasson ..... 137/223
3,790,975 A 2/1974 Philipp et al. ..... 5/349
3,798,686 A 3/1974 Gaiser ..... 5/343
3,831,628 A 8/1974 Kintner et al.
3,840,922 A 10/1974 Morrison et al. ..... 5/348 R
3,864,766 A 2/1975 Prete, Jr. ..... 5/337
3,877,092 A 4/1975 Gaiser ..... 5/343
3,973,588 A 8/1976 Holst ..... 137/854
3,983,907 A 10/1976 Sorensen ..... 137/223
3,995,653 A 12/1976 Mackal et al. ..... 137/234
4,025,974 A 5/1977 Lea et al. ..... 5/367
4,078,580 A 3/1978 Rudle ..... 137/625.66
4,080,105 A 3/1978 Connell ..... 417/26
4,099,773 A 7/1978 Chang ..... 297/270
4,146,069 A 3/1979 Angarola et al. ..... 141/68
4,146,070 A 3/1979 Angarola et al. ..... 141/68
4,149,285 A 4/1979 Stanton ..... 5/347
4,169,295 A 10/1979 Darling ..... 5/450
4,176,681 A 12/1979 Mackal ..... 137/516.29
4,225,989 A 10/1980 Corbett et al. ..... 5/453
4,371,999 A 2/1983 Reid ..... 5/457
4,442,838 A 4/1984 Samson et al. ..... 128/369
4,478,587 A 10/1984 Mackal ..... 441/41
4,488,323 A 12/1984 Colburn ..... 5/460
4,521,166 A 6/1985 Phillips ..... 417/478
4,579,141 A 4/1986 Arff ..... 137/223
4,594,743 A * 6/1986 Owen et al. ..... 5/111
4,644,597 A 2/1987 Walker ..... 5/449
4,678,014 A 7/1987 Owen et al. ..... 141/67
4,712,574 A 12/1987 Perrott ..... 136/217
4,734,017 A 3/1988 Levin ..... 417/366
4,766,628 A 8/1988 Walker ..... 5/449
4,815,153 A * 3/1989 Bleser et al. ..... 5/98.1
4,829,616 A 5/1989 Walker ..... 5/453
4,862,533 A 9/1989 Adams, III ..... 5/413
4,896,389 A 1/1990 Chamberland ..... 5/453
4,897,890 A 2/1990 Walker ..... 5/453
4,970,741 A 11/1990 Spina ..... 5/417
4,977,633 A 12/1990 Chaffee ..... 5/453
4,982,466 A 1/1991 Higgins et al. ..... 5/453
5,052,894 A 10/1991 Rimington ..... 417/44
5,068,933 A 12/1991 Sexton ..... 5/441
5,079,785 A 1/1992 Garcia ..... 5/431
5,109,560 A 5/1992 Uetake ..... 5/453
5,111,838 A 5/1992 Langston ..... 137/233
5,343,889 A 9/1994 Jaw ..... 137/232
5,598,593 A * 2/1997 Wolfe ..... 5/710
5,960,495 A 10/1999 Hsu et al. ..... 5/706
6,076,214 A 6/2000 Klimenko ..... 5/710
6,108,844 A * 8/2000 Kraft et al. ..... 5/732
6,161,902 A 12/2000 Lieberman ..... 297/452.41
6,240,584 B1 * 6/2001 Perez et al. ..... 5/713

* cited by examiner

INCREASED HEIGHT INFLATABLE SUPPORT SYSTEM

FIELD OF THE INVENTION

The present invention relates to the field of inflatable support systems, which may include air mattresses and inflation control thereof.

BACKGROUND OF THE INVENTION

Most everyone has faced the need for an extra bed or mattress at some time in their life. Air mattresses, originally introduced many years ago, have allowed homeowners and others to provide their guests with a surface more comfortable than sleeping on the floor, while not imposing the same storage requirements on the homeowner as traditional mattresses.

While air mattresses are a significant improvement over sleeping on the ground or curled up on a sofa, the mattresses still have many problems. For example, original air mattress designs were often clunky and uncomfortable, the manufacturing techniques and materials used resulted in poor air retention, the inflation and deflation systems employed with such mattresses often required significant time and effort, and the mattresses tended to provide only marginal support.

Some in the prior art, such as U.S. Pat. No. 4,977,633, issued to Robert B. Chaffee on Dec. 18, 1990 ("the Chaffee patent"), and U.S. Pat. No. 5,960,495, issued to Yaw-Yuan Hsu, et al. on Oct. 5, 1999 ("the Hsu patent"), have attempted to address some of these shortcomings. By way of example, the Chaffee patent teaches the use of a large, manually operated pressure release valve to speed deflation. The Chaffee patent also teaches the inclusion of a small cylinder around which a deflated bed can be rolled, further simplifying deflation. This same arrangement also allows the bed to automatically unroll while being inflated, which also simplifies the inflation process. The Chaffee patent also illustrates the inclusion of an electric motor, which speeds the inflation process.

The Hsu patent attempts to address some of the comfort problems typically associated with air mattresses. The Hsu patent uses tube beams inside a mattress to provide additional lateral load support. These tube beams are separate structures which are added to the inside of the mattress and are attached to the upper and lower mattress surfaces through a sinusoidal sealing pattern in an attempt to provide further rigidity to the mattress.

Despite advances in the art, no one marketed an inflatable mattress that approximates the height of a traditional bed. Instead, a person sleeping on one of these mattresses still has the perception of sleeping on the floor. In addition, getting into and out of such a bed can be difficult, especially for an elderly or disabled person. An inflatable mattress that more closely approximates the dimensions of a traditional bed would therefore be advantageous.

Another problem commonly encountered by inflatable mattress users is the propensity for such mattresses to roll over. Rollovers are not only a problem with inflatable mattresses, but with all lightweight support surfaces, such as inflatable furniture. Some in the prior art, such as U.S. Pat. No. 6,161,902, issued to Marvin S. Lieberman on Dec. 19, 2000 (the Lieberman patent); the "Game Day Minute Chair" by Aero Products International, Inc. of Wauconda, Ill.; and the "Retro Air Chair" by Intex Recreation Corporation of Long Beach, Calif., have used multiple, inflatable cylindrical tubes to improve the stability of inflatable chairs.

While the stabilization methods employed in the prior art can improve overall chair stability, each has shortcomings, especially when applied to other support systems. For example, the Lieberman patent teaches the installation of a U shaped inflatable tube underneath the front of a chair and a small, inflatable tube which extends along and is immovably attached to the rear base of the chair. Each of these tubes is also inflated separately from and to a higher pressure than the body of the chair. The increased pressure of these tubes strengthens the base of the chair, thus reducing the likelihood of rollover. While this approach has some merit, the introduction of separately inflatable tubes means added work for the consumer, who must move an inflation device from one valve to another until the chair is properly filled.

The Game Day Minute Chair and Retro Air Chair apply alternative stabilization techniques. In both cases, two small, inflatable stabilizer bars, no more than fifteen inches long and approximately six inches in diameter when inflated, are attached to the base of the chair to increase the surface area covered by the chair. These stabilizer bars are attached to the chair through narrow, short inflator tubes(three and one half inches long by one and one half inches wide in the case of the Game Day Minute Chair). The inflator tubes allow the stabilizer bars to be in fluid communication with the chair bodies and to be filled with air as the chair is filled. The increased surface area created by the combination of the inflator tubes and the stabilizer bars provides more stability by distributing the weight over a larger area.

As with the Lieberman patent, the shape and position of the stabilizer bars employed on these chairs also strengthens the chair body where the stabilizer bars contact the chair. However, such strengthening is only provided to areas adjacent to the tubes. While this may be practical for inflatable support systems with smaller weight bearing surfaces, such as chairs, a few, relatively short stabilizer bars will not provide stability for larger inflatable support systems, such as inflatable mattresses.

Another problem faced by inflatable support systems of the prior art is structural stability of the sides of the support system. The shape of the side tends to distort as weight is applied at or near the edge of the support system. Such distortion can cause a person to slip or fall from the support surface, increasing potential liability on the part of the support system manufacturer. Obviously, this becomes increasingly significant as the height of the support system is increased. A means of improving the structural stability of the side of the mattress is therefore preferable as height is increased.

SUMMARY OF THE INVENTION

Accordingly, the present invention is directed to an increased height inflatable support system that substantially obviates one or more of the problems due to limitations and disadvantages of the related art.

An object of the present invention is to improve the structural stability of the support system sides.

Another object of the invention is to reduce the likelihood of support system rolling over.

A further object of the invention is to increase overall support system height to more closely approximate the height of a standard bed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

A preferred embodiment of the present invention is an increased height inflatable mattress. This increased height can improve the perceived comfort of the mattress, as it allows a user to feel more like they are sleeping on a traditional bed. The increased height is achieved by vertically stacking two or more inflatable chambers. In a preferred embodiment, these stacked chambers are in fluid communication with each other, such that all chambers can be inflated from a single valve. In an alternative embodiment, the stacked chambers may be separately inflatable.

A preferred embodiment of the present invention addresses the shortcomings of the prior art by including one or more stabilizer bars and one or more support chambers. Stabilizer bars reduce the likelihood of support system rollovers by effectively increasing the surface area across which weight added to a support system is distributed. In a preferred embodiment, stabilizer bars are flexibly attached to a support system along one or more sides, and at or near the bottom of the support system. In one embodiment, stabilizer bars can be in fluid communication with the support system, thereby allowing the stabilizer bars to be inflated as the support system is inflated. In an alternative embodiment, stabilizer bars may be comprised of separately inflatable chambers. In still another embodiment, stabilizer bars may be constructed such that a rigid or semi-rigid material, such as, but not limited to, plastic or cardboard, can be engaged into a holder, such as a sleeve, attached to the support system.

The support chamber portion of the preferred embodiment is an inflatable chamber which is attached to the side walls of the support system. In one embodiment, support chambers can be attached at any chamber junctions within a support system. The shape and position of the support chambers allows the support chambers to reinforce chamber junction edges, thereby increasing the strength of the overall support system.

In a preferred embodiment, all inflatable chambers of the support system are in either direct or indirect fluid communication with other chambers of the support system. This can allow the support system to be inflated from a single motor, with the simple flip of a switch. In an alternative embodiment, some or all inflatable chambers may be separately inflatable, thereby allowing each chamber to be filled to a unique pressure.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
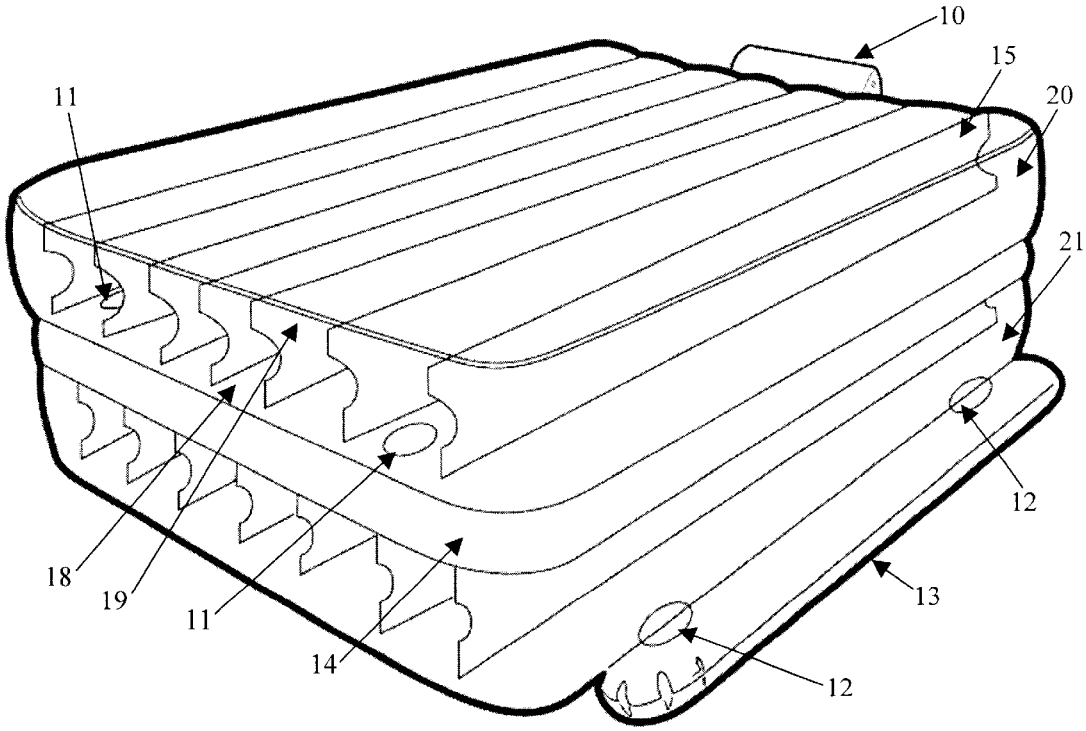
FIG. 1 is a perspective view of the internal structure of a mattress embodiment of the present invention.
Figure 7:
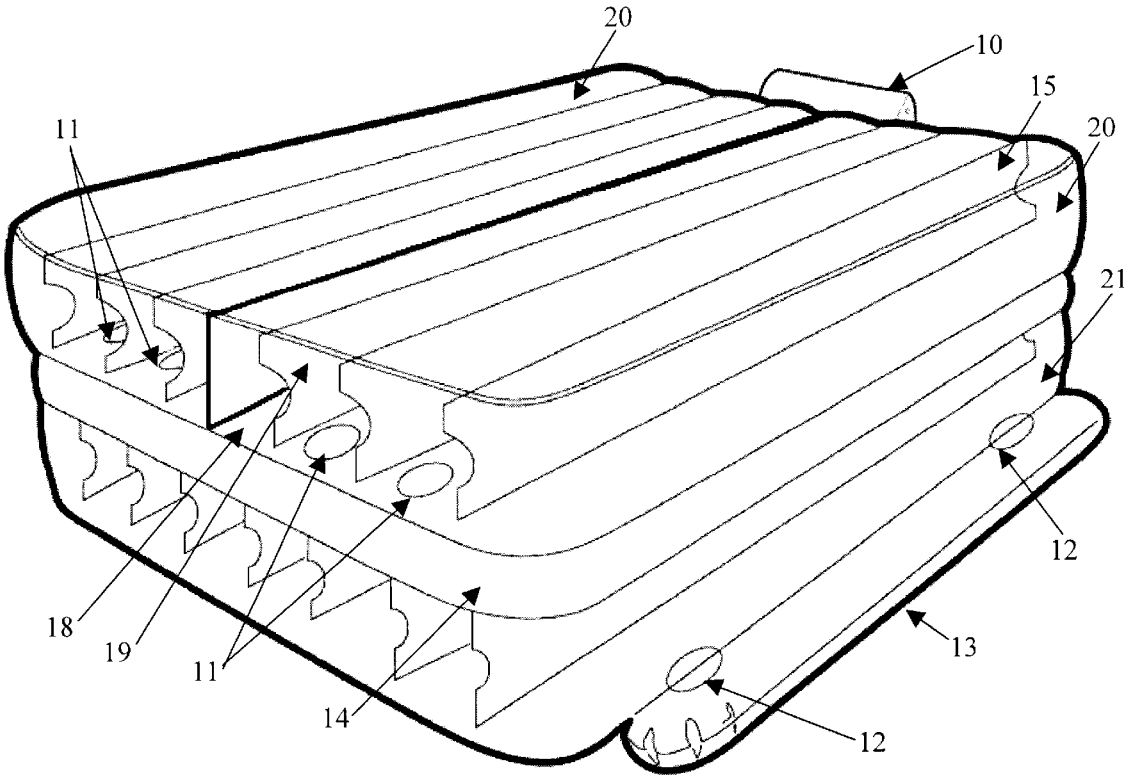
FIG. 7 is a perspective view of an alternative mattress embodiment of the present invention employing multiple upper chambers.

FIG. 1 is a perspective view of the internal structure of a mattress embodiment of the present invention. As FIG. 1 illustrates, the presently preferred embodiment is comprised of two support chambers, 20 and 21, stacked vertically. In the embodiment illustrated in FIG. 1, upper chamber 20 is constructed with side gussets approximately ten inches high, and lower chamber 21 is constructed with side gussets approximately fifteen inches high. It should be clear to one skilled in the art that alternative side gusset heights and chamber arrangements could be substituted without departing from the spirit and scope of the present invention. By way of example, FIG. 7 illustrates the use of multiple upper chambers.

As FIG. 1 illustrates, a motorized pump 10 is attached to upper chamber 20. Pump 10 should be powerful enough to fill the entire support system with a gas or fluid, such as air, such that upper chamber 20 can provide comfortable support to a user. Inflation of the support system can begin by pressing a button on or near pump 10, as is illustrated by button 23 in FIG. 3. Pump 10 may automatically stop inflating the support system when the pressure within the support system reaches a limit selectable by a user. In addition, should a user desire to gradually decrease the pressure within the support system, a user simply activates a push-button valve, illustrated as valve 27 in FIG. 3. Pump 10 may also monitor support system air pressure and automatically add additional air if the pressure falls below a level selected by a user.

Air entering upper chamber 20 may flow to lower chamber 21 through a series of reinforced holes 11. In the embodiment illustrated in FIG. 1, holes 12 allow stabilizer bars 13 to be in fluid communication with lower chamber 21. FIG. 1 also illustrates the use of support chamber 14 to reinforce the junction between upper chamber 20 and lower chamber 21. In the preferred support system embodiment illustrated in FIG. 9, chamber 14 runs circumferentially around the support system at the junction between upper chamber 20 and lower chamber 21.

Again referring to FIG. 1, upper chamber 20, lower chamber 21, stabilizer bars 13, and support chamber 14 are preferably made from heavy weight (preferably 18 gauge) polyvinylchloride (PVC) or other watertight and airtight material. PVC may be preferably attached to PVC or other material by electronically "welding" the PVC to the other material, although other attachment means, such through a chemical bond or by stitching edges of each sheet together, may also be used. Such an attachment means may be used, for example, to join the top of a chamber with the side of a chamber or to add a layer of fabric, padding, flocking, or other material (collectively "fabric") to the PVC.

Within upper chamber 20 and lower chamber 21, PVC strips 15 can be attached to the inner surface of the top and bottom of each chamber, illustrated as 18 and 19. Such PVC strips 15 create channels, which help to shape and structurally reinforce upper chamber 20 and lower chamber 21. It should be apparent to one skilled in the art that alternative chamber support architectures, such as the "coil construction" technique known in the art, may be employed without departing from the spirit or scope of the present invention.

Figure 2:
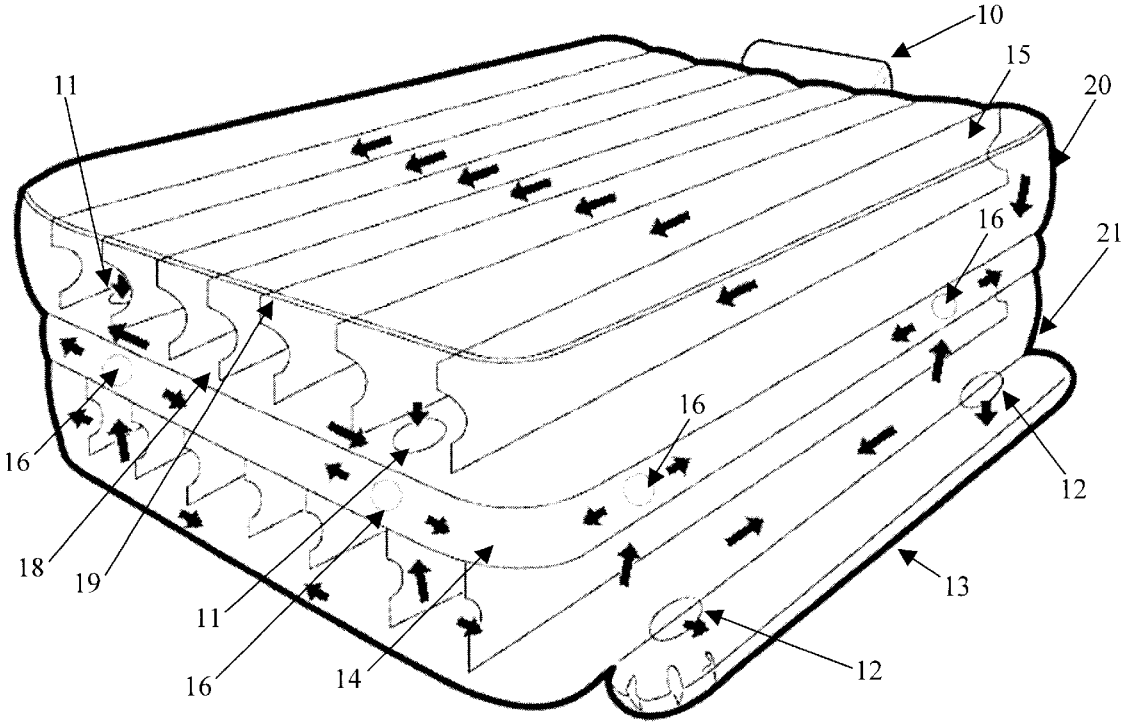
FIG. 2 is a perspective view of the internal structure of a mattress embodiment of the present invention also illustrating air flow inside said mattress.

FIG. 2 is a perspective view of the internal structure of a mattress embodiment of the present invention, also illustrating the flow of air or other fluid inside said mattress. As FIG. 2 illustrates, air enters the support system at pump 10 and travels through the channels created by PVC strips 15 within upper chamber 20. PVC strips 15 are preferably shaped such that air is able to flow past the ends of PVC strips 15, thereby allowing air to circulate within upper chamber 20 and lower chamber 21.

As upper chamber 20 inflates, air can enter lower chamber 21 through holes 11. A preferred embodiment uses four such holes, each of which is approximately three quarters of an inch in diameter. Each hole 11 is substantially centered within a circular weld four inches in diameter, where such a weld can also serve to attach upper chamber 20 to lower chamber 21. It should be obvious to one skilled in the art that other hole arrangements, including, but not limited to, fewer holes of a larger size, or more holes of a smaller size, may also be used.

While such alternative hole arrangements may be used, it was found during product development that the placement of holes 11 is important for proper durability and inflation. Specifically, it was found that placing holes 11 in the outermost channel of upper chamber 20 tended to result in tears along PVC strips 15 in lower chamber 21. Locating holes 11 in the second channel from the end has proved to generate the least number of tears in PVC strips 15 while stilling allowing rapid inflation of both upper chamber 20 and lower chamber 21.

Figure 8:
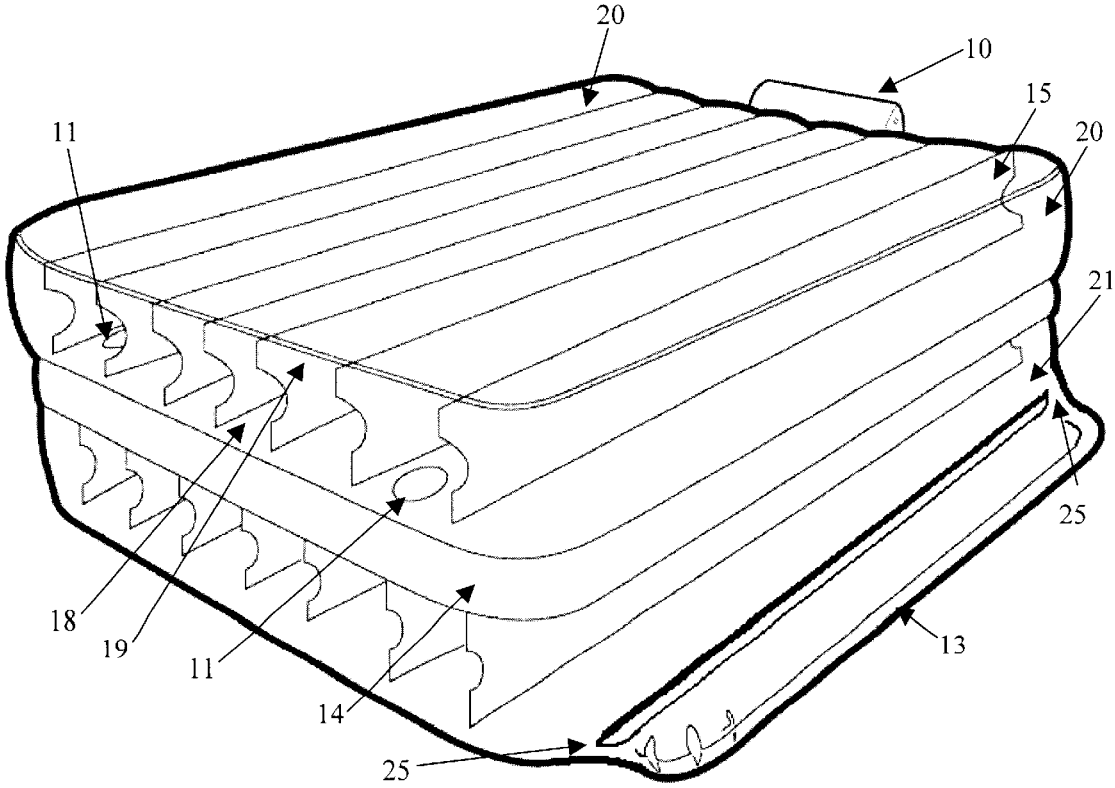
FIG. 8 is a perspective view of an alternative mattress embodiment of the present invention in which the illustrated stabilizer bar is in fluid communication with the lower chamber through a series of tubes.

As lower chamber 21 inflates, air can also flow into stabilizer bars 13. In the embodiment illustrated in FIG. 2, air can flow into and out of stabilizer bars 13 through a series of holes 12. FIG. 8 illustrates a preferred stabilizer bar embodiment, in which stabilizer bar 13 is in fluid communication with lower chamber 21 through two short tubes 25. While the position of tubes 25 does not impact the ability of stabilizer bar 13 to inflate, tubes 25 are preferably located approximately one and one half inches from the ends of stabilizer bar 13. As illustrated in both FIG. 2 and FIG. 8, stabilizer bars 13 are flexibly attached to the side gusset of lower chamber 21, preferably near the bottom of the side gusset.

Figure 6:
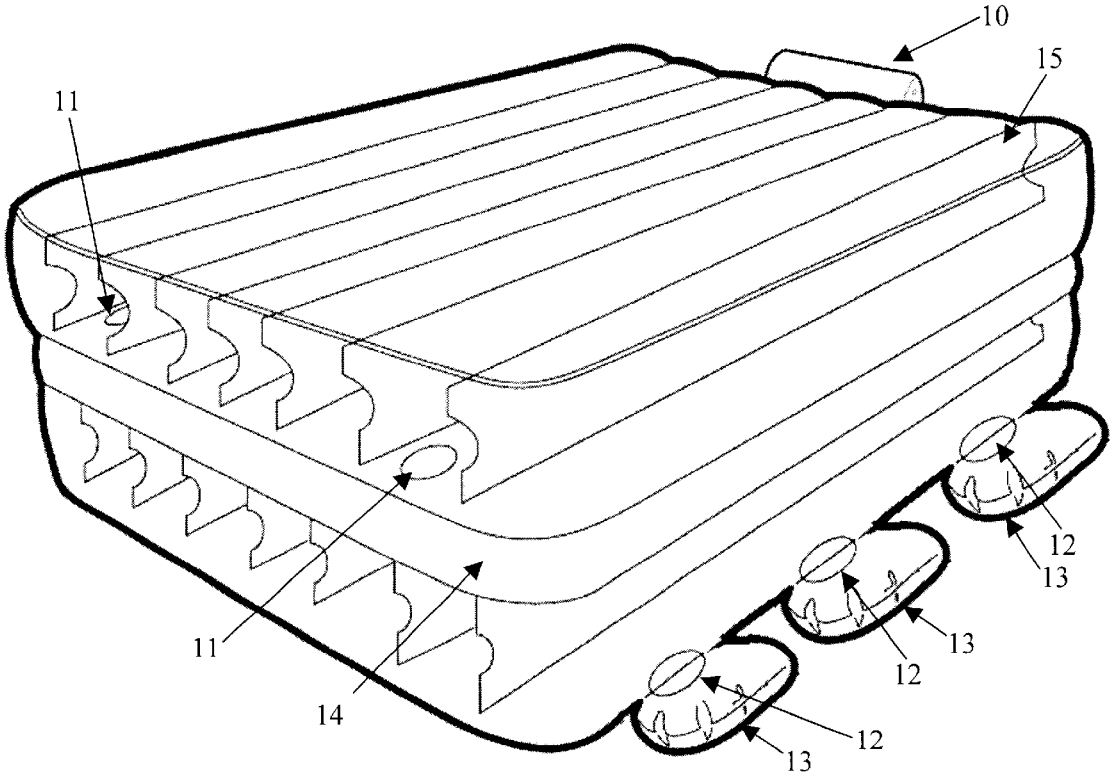
FIG. 6 is a perspective view of an alternative mattress embodiment of the present invention employing multiple stabilizer bars.

While FIG. 2 illustrates the use of a single stabilizer bar of a length substantially equal to the length of the support system, alternative stabilizer bar arrangements can also be envisioned. For example, FIG. 6 provides an alternative perspective view of a mattress embodiment of the present invention employing multiple stabilizer bars. It should be noted that, unlike the stabilizer bars used in the prior art, the stabilizer bar arrangements employed by the present invention provide stabilization along almost the entire length of at least one side of the support system.

FIG. 2 also illustrates a preferred inflation means for support chamber 14. As FIG. 2 illustrates, support chamber 14 is in fluid communication with lower chamber 21 through a series of holes 16. In a preferred embodiment, holes 16 are approximately three quarters of an inch in diameter, and are substantially centered in reinforced PVC.

In an alternative embodiment, support chamber 14 may receive air from upper chamber 20. In still another embodiment, support chamber 14 may be in fluid communication with both upper chamber 20 and lower chamber 21. In yet another embodiment, support chamber 14 may be separately inflatable, thereby allowing support chamber 14 to be inflated to a pressure greater than the pressure in the remaining support system.

Figure 3:
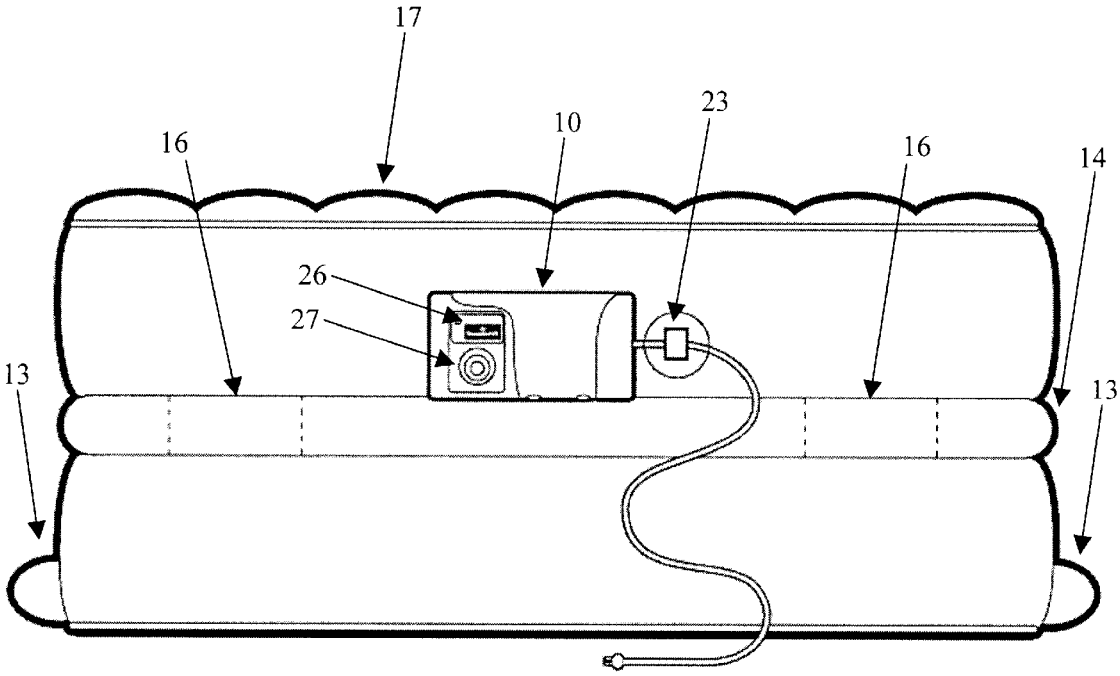
FIG. 3 is a front planar view of a mattress embodiment of the present invention.

FIG. 3 is a front planar view of a mattress embodiment of the present invention. As FIG. 3 illustrates, an one or more layers of fabric 17 may be added to the outside of upper chamber 20 in a preferred support system embodiment. While it is preferred that fabric 17 be laminated to upper chamber 20, additional attachment means, such as, but not limited to, chemical adhesives, electronic welding, or sewing, may also be used.

Figure 4:
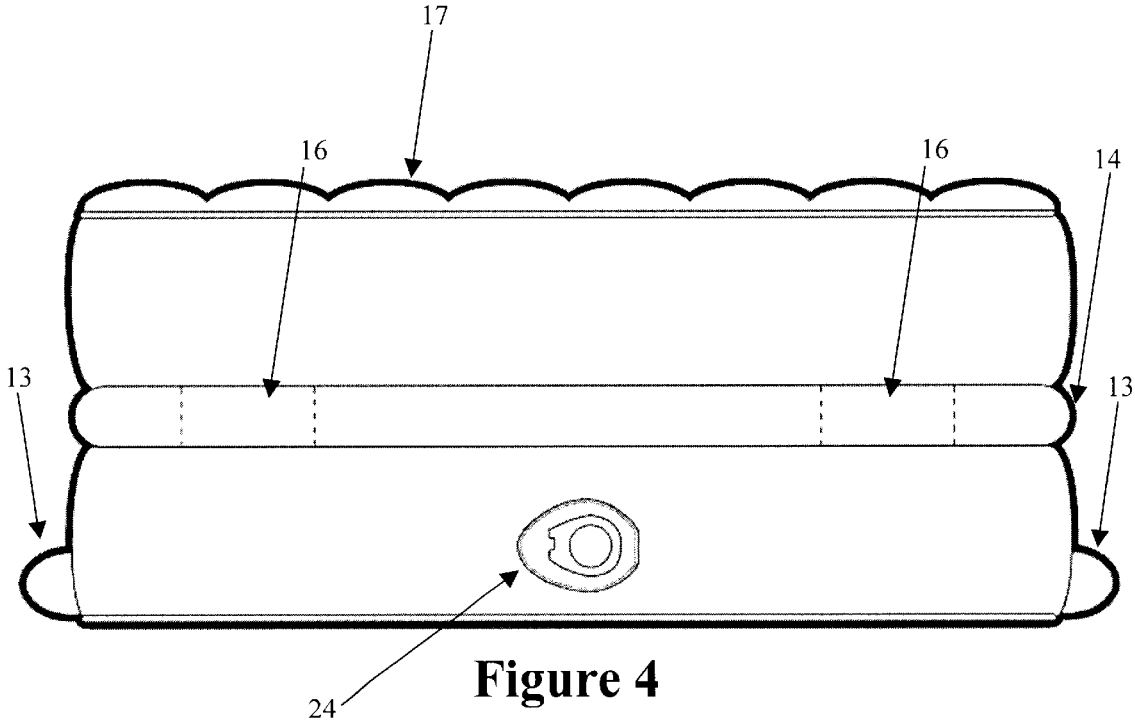
FIG. 4 is a rear planar view of a mattress embodiment of the present invention.
Figure 5:
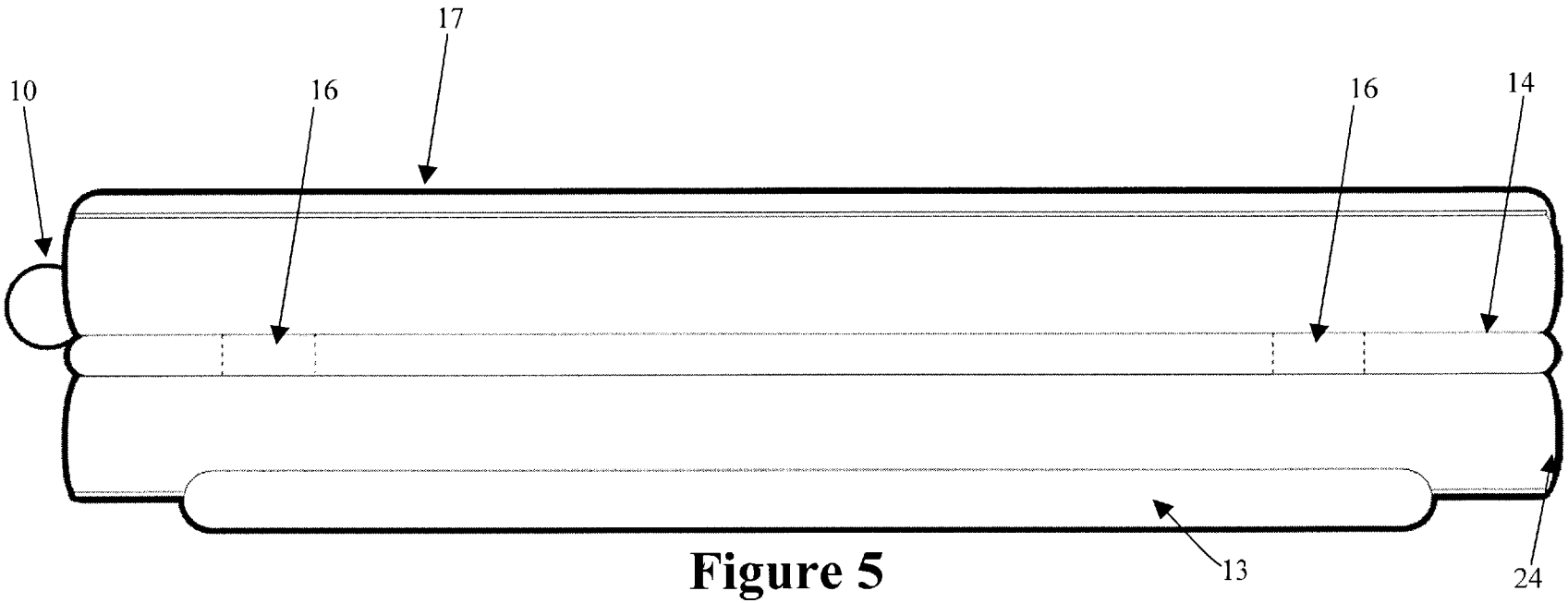
FIG. 5 is a side planar view of a mattress embodiment of the present invention.

FIG. 4 is a rear planar view of a mattress embodiment of the present invention which highlights valve 24. In the embodiment illustrated in FIG. 4, valve 24 is located substantially in the center of lower chamber 21 at the end opposite from which pump 10 is attached to upper chamber 20. This arrangement is preferred, as it allows the weight of the support system to force air through valve 24. This, in turn, allows the support system to be quickly deflated for storage. The arrangement of valve 24 with respect to pump 10 is more clearly illustrated in FIG. 5.

FIG. 7 is an alternative perspective view of a mattress embodiment of the present invention, illustrating the use of multiple upper chambers 20. In the embodiment illustrated in FIG. 7, said upper chambers can be in fluid communication with lower chamber 21. In an alternative embodiment, upper chambers 20 may be separately inflatable, allowing users to select a desired firmness for each upper chamber. In this embodiment, air from pump 10 may be redirected into either or both upper chambers 20 by enabling or disabling one or more valves 26 connected to each chamber (illustrated in FIG. 3).

Figure 9:
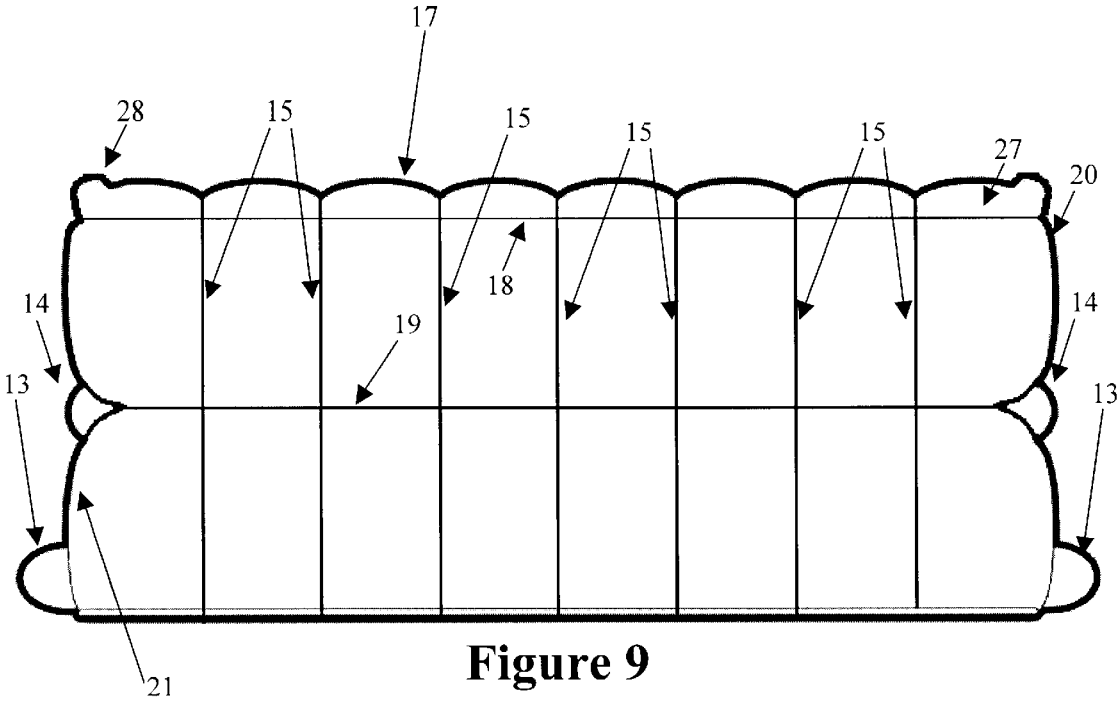
FIG. 9 is a cross-sectional view of the mattress embodiment of the present invention illustrated in FIG. 4.

FIG. 9 is a cross-sectional view of the mattress embodiment of the present invention illustrated in FIG. 4. In addition to illustrating a preferred stabilizer chamber 14 embodiment, FIG. 9 also illustrates the use of an additional chamber 27. In this embodiment, chamber 27 does not have a side gusset, which results in a rounded outer edge 28. In addition, chamber 27 has dimensions substantially equal to those of chamber 20. Chamber 27 can also be welded to give chamber 27 a quilted appearance, and chamber 27 can be covered with flocking or other material to give chamber 27 a velvety soft texture. Through the addition of such a chamber 27, support system as a whole can more closely approximate the look and feel of a traditional bed.

Through the arrangements set forth above, the present invention provides an increased height support system that yields increased comfort, added stability, and improved structural integrity over the prior art.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. An inflatable mattress with at least one inflatable stabilizer bar attached to at least one side of the mattress near the bottom support surface of the mattress, where the at least one stabilizer bar is of a size substantially equal to or greater than the length of a side of the mattress and of a height less than the height of the mattress, and where the at least one stabilizer bar is in fluid communication with the inflatable mattress.

2. The inflatable mattress of claim 1, wherein said inflatable mattress comprises a top chamber in fluid communication with a bottom chamber, each of said chambers having a top layer, a bottom layer and a side gusset.

3. The inflatable mattress of claim 2, wherein there are a plurality of stabilizer bars.

4. The inflatable mattress of claim 2, wherein said at least one stabilizer bar is in fluid communication with said bottom chamber.

5. The inflatable mattress of claim 4, further comprising a series of parallel channels defined within said bottom chamber.

6. The inflatable mattress of claim 5, further comprising a series of parallel channels defined within said top chamber.

7. The inflatable mattress of claim 5, wherein said parallel channels are formed from material attached to the inner surfaces of said top layer and said bottom layer of said bottom chamber.

8. The inflatable mattress of claim 6, wherein said parallel channels are formed from material attached to the inner surfaces of said top layer and said bottom layer of said top chamber.

9. The inflatable mattress of claim 7, wherein said material forming said channels in said bottom chamber is PVC.

10. The inflatable mattress of claim 8, wherein said material forming said channels in said top chamber is PVC.

11. The inflatable mattress of claim 10, further comprising at least one pressure control device capable of controlling the firmness of said top and bottom chambers.

12. An inflatable mattress with a plurality of inflatable stabilizer bars attached to at least one side of the mattress near the bottom support surface of the mattress, where the sum total of the stabilizer bar lengths is substantially equal to or greater than the length of a side of the mattress, the height of each of the stabilizer bars is less than the height of the mattress, and the stabilizer bars are in fluid communication with the inflatable mattress.

13. The inflatable mattress of claim 12, wherein said inflatable mattress includes four sides, said sides comprising two parallel long sides and two parallel short sides.

14. The inflatable mattress of claim 13, wherein said stabilizer bars are attached to at least said long parallel sides.

15. The inflatable mattress of claim 14, wherein said stabilizer bars are attached to at least three sides of said mattress.

16. The inflatable mattress of claim 15, wherein said stabilizer bars are attached to four sides of said mattress.

* * * * *

UNITED STATES PATENT AND TRADEMARK OFFICE

CERTIFICATE OF CORRECTION

PATENT NO. : 6,701,559 B2
DATED : March 9, 2004
INVENTOR(S) : Karen L. Boso et al.

It is certified that error appears in the above-identified patent and that said Letters Patent is hereby corrected as shown below:

Title page,
Item [75], Inventors, delete “Woodstock,” and substitute -- Fox River, -- in its place.

Column 5,
Line 44, delete “stilling” and substitute -- still -- in its place.

Signed and Sealed this

Twenty-fourth Day of August, 2004

JON W. DUDAS
*Director of the United States Patent and Trademark Office*